US006901844B2

(12) United States Patent
Djordjevic

(10) Patent No.: US 6,901,844 B2
(45) Date of Patent: Jun. 7, 2005

(54) GUIDED SHOE FOR RADIAL PISTON PUMP

(75) Inventor: Ilija Djordjevic, East Granby, CT (US)

(73) Assignee: Stanadyne Corporation, Windsor, CT (US)

( * ) Notice: Subject to any disclaimer, the term of this patent is extended or adjusted under 35 U.S.C. 154(b) by 44 days.

(21) Appl. No.: 10/217,831

(22) Filed: Aug. 12, 2002

(65) Prior Publication Data

US 2004/0025684 A1 Feb. 12, 2004

Related U.S. Application Data

(63) Continuation of application No. 10/187,823, filed on Jul. 2, 2002, now Pat. No. 6,694,950.

(51) Int. Cl.[7] ..... F01B 1/00
(52) U.S. Cl. ..... 92/72
(58) Field of Search ..... 91/491; 92/61, 92/72; 417/273

(56) References Cited

U.S. PATENT DOCUMENTS 5,364,234 A * 11/1994 Eickmann ..... 92/72
5,876,186 A 3/1999 Stiefel
6,183,212 B1 2/2001 Djordjevic
2002/0174855 A1 11/2002 Djordjevic
2002/0189438 A1 * 12/2002 Furuta ..... 92/72

FOREIGN PATENT DOCUMENTS

WO WO 01/92709 A2 12/2001
WO WO 03/023221 A1 3/2003

* cited by examiner

*Primary Examiner*—F. Daniel Lopez
(74) *Attorney, Agent, or Firm*—Alix, Yale & Ristas, LLP

(57) ABSTRACT

A radial piston pump in which the sliding shoe has a central region that engages the driven end of the piston and an outer region or rim surrounding the driven end of the piston and projecting into the pumping chamber bore a distance such that for all positions of the piston relative to the drive member, at least a portion of the outer region of the shoe remains within the pumping chamber bore. In another aspect, the invention is directed to a sliding shoe for a radial piston pump, wherein the shoe has a concave bottom side, a socket portion projecting centrally on the top side, and a plurality of guide arms projecting upwardly on the top side and spaced laterally from the socket portion. Preferably, the projecting rim is in the form of guide arms that are spaced apart to form a castellated, substantially annular rim around the socket portion.

20 Claims, 4 Drawing Sheets

GUIDED SHOE FOR RADIAL PISTON PUMP

This application is a continuation of application Ser. No. 10/187,823, filed Jul. 2, 2002, now U.S. Pat. No. 6,694,950, under the provisions of 35 U.S.C.§120.

BACKGROUND OF THE INVENTION

The present invention relates to radial piston pumps and more particularly, to radial piston pumps of the type used in fuel supply systems for internal combustion engines.

Radial piston pumps, particularly the type used for pressurizing fuel for delivery to the combustion chambers of internal combustion engines, typically have a housing defining a central cavity and a drive member mounted about a drive axis for rotation in the cavity. At least one piston bore extends radially relative to the axis, through the housing to the cavity. A piston oriented radially within the piston bore has a radially outer pumping end and a radially inner driven end cooperating with the drive member for reciprocal movement in the piston bore between top dead center and bottom dead center travel limits. A sliding shoe engages the driven end of the piston and bears on the drive member, for providing the cooperation whereby the rotary movement of the drive member is converted to the reciprocal movement of the piston. A return spring urges the driven end of the piston toward the shoe and the drive member. For the type of pump to which the present invention is especially directed, the drive member is eccentric, i.e., it has an outer circular surface with a center that is offset with respect to the drive axis. The driven end of the piston bears pivotally against, without being rigidly attached to, the shoe, to accommodate the eccentric path of the drive member.

Particularly in operational modes where the pumping chamber of the piston is not fully charged before the pressurization, or discharge, stroke of the piston, unbalanced forces can act on the shoe with potentially detrimental, if not disastrous, results. Such unbalanced forces can result in separation of the shoe from both the driven end of the piston and the drive member while the piston is at or near the top dead center position such that, despite the restorative forces of the return spring, the piston does not seat properly in the shoe, or in the worst scenario, the shoe is carried into the cavity, resulting in catastrophic damage to the pump.

One type of pump and associated control scheme in which this problem can arise, and for which the invention is particularly suited, is described in U.S. application Ser. No. 10/187,823, filed on Jul. 2, 2002, entitled "Hybrid Control Method in Fuel Pump Using Intermittent Recirculation at Low and High Engine Speeds".

SUMMARY OF THE INVENTION

It is thus an object of the present invention to improve the performance and reliability of the sliding shoe associated with the conversion of rotating motion of a drive member, to the reciprocal motion of the pumping pistons, in a radial piston pump.

According to one aspect, the invention is directed to a radial piston pump in which the sliding shoe has a central region that engages the driven end of the piston and an outer region or rim surrounding the driven end of the piston and projecting into the pumping chamber bore a distance such that for all positions of the piston relative to the drive member, at least a portion of the outer region of the shoe remains within the pumping chamber bore.

In another aspect, the invention is directed to a sliding shoe for a radial piston pump, wherein the shoe has a concave bottom side, a socket portion projecting centrally on the top side, and a plurality of guide arms projecting upwardly on the top side and spaced laterally from the socket portion.

Preferably, the projecting rim is in the form of guide arms that are spaced apart to form a castellated, substantially annular rim around the socket portion, such that in the event of separation of the driven end of the piston from the socket and the bottom side of the shoe from the drive member, with a resulting "floating" and misorientation of the shoe, at least a portion of one and preferably two of the guide arms, remains within the mounting bore of the piston, thereby preventing the shoe from experiencing excessive misorientation or displacement into the cavity.

BRIEF DESCRIPTION OF THE DRAWINGS

The preferred embodiment will be described below with reference to the accompanying drawing, in which.

DESCRIPTION OF THE PREFERRED EMBODIMENT

Figure 1:
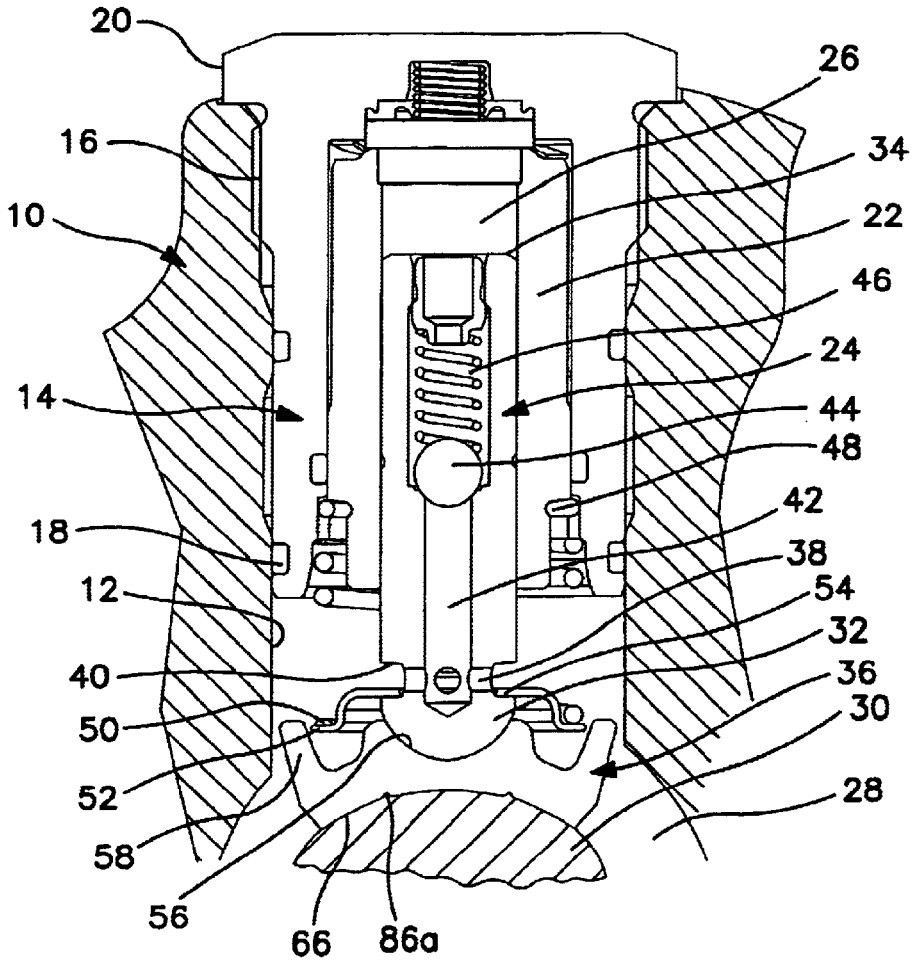
FIG. 1 is a sectional view of a portion of a radial piston pump, showing the preferred form of the sliding shoe according to the invention, as well as the preferred relationship of the outer region of the sliding shoe to the pumping chamber mounting bore, when the piston is in the bottom dead center position.

FIG. 1 shows a pump housing 10 having a bore 12 in which is mounted a pumping chamber assembly 14, for example, via a threaded connection 16 with associated seals 18 and cap 20. The assembly includes a generally cylindrical piston chamber wall 22, in which the pumping piston or plunger 24 is oriented for reciprocal motion. In a retracted or bottom dead center position, the portion 26 of the chamber is filled, or partially filled with relatively low pressure feed fuel. Upon driving of the piston toward the top dead center position, the fuel in the pumping chamber 26 is highly pressurized and discharged for ultimately delivery, such as by injection, to the engine cylinders.

The piston mounting bore 12 opens to a cavity 28 of the housing where feed fuel is maintained at a relatively low pressure and where a rotating drive member, especially an eccentric drive member 30, is mounted for rotation about a drive axis. Thus, the piston bore extends radially, relative to the drive axis, through the housing to the cavity, and the piston 24 is oriented radially within the piston bore. The piston has a radially inner, driven end 32, preferably in the form of a bulb or portion of a sphere, and a radially outer pumping end 34. A sliding shoe 36 is provided for pivotally engaging the driven end 32 of the piston while sliding on the outer surface of the drive member 30, to convert the radial motion of the drive member to the reciprocal motion of the piston.

In the illustrated embodiment, one or more charging orifices 38 are situated at the driven end, adjacent the spherical head 32, for fluid communication with the low-pressure fuel and cavity 28. This orifice 38 can be formed in a notch or neck 40, from which the head 32 extends downwardly. A charging passage 42 extends from the charging orifice 38 in fluid communication with the pumping chamber 26, through the center of the piston 24. A check valve 44 with associated spring 46 are mounted in the charging passage 42, for permitting fuel flow therein during charging from the cavity, but preventing fuel from flowing back into the cavity 28 during pressurization of the fuel in the pumping chamber 26. A piston return spring, such as a coil spring, is mounted at one end 48 to a shoulder on the cylinder wall 22, concentrically but exterior to the lower portion of piston 24, and has another end 50 bearing on a rim or flange portion 52 of a spring seat which has a inner portion 54 bearing on a shoulder of the notch 40 associated with head 32.

The sliding shoe 36 has an upper or top side on which a socket 56 is formed for the pivotal engagement via complementary concave surface to the convex surface formed by driven end 32 of the piston. The socket 56 and the spherical end 32 are both preferably formed at the surfaces of rotation about a common axis, e.g., the piston reciprocation axis. The shoe has an outer region 58 surrounding the driven end 32 of the piston and projecting into the piston bore 12. As will be described in greater detail below, all or some of such projection remains in the piston bore 12 during all positions of the piston 24 relative to the drive member 30. The return spring 50 extends longitudinally along a portion of the piston bore 12 externally of the piston 24 and acts on the driven end of the piston, and the outer region of shoe 58 projects into the piston bore in overlapped relation to the return spring when the piston bears against the central region of the shoe, as shown. In other words, the outer region 58 of the shoe overlaps the return spring 50 when the piston is at the bottom dead center position. As will be described in greater detail below, the outer region 58 overlaps the return spring 50 when the piston is at the top dead center position as well. This is preferably implemented by configuring the piston 24 and shoe 36 in relation to the drive member 30, such that when the complementary surfaces or formations of the piston head 32 and the shoe socket 56 are engaged, these formation are in the piston bore 12 and the outer region 58 on the shoe extends into the piston bore 12 a greater distance than the engagement of the complementary formations.

It can be appreciated from FIG. 1, that the outer region 58 of the shoe is annularly spaced about the socket 56 formed in the central region of the shoe, thereby defining an annular space between the central region and the outer region of the shoe. The rim portion 52 of the return spring seat, and the radially inner end 50 of the return spring, are situated in the space when the head 32 is fully engaged with the socket 56.

As may be further appreciated with reference to FIGS. 1, 5, 6, 7 and 8, the sliding shoe 36 preferably has top 60 and bottom 62 sides for cooperatively connecting the piston at the top with the drive member at the bottom. The sliding shoe 36 can be considered as having a base 64 having a concave bottom surface 66, a socket portion 56 projecting centrally on the top side, and a plurality of guide arms 58 projecting upwardly on the top side and spaced laterally from the socket portion. The plurality of guide arms preferably form a castellated, substantially annular rim around the socket portion. The upper surface 70 of the base is generally convex, and the arms project obliquely away from each other from the upper surface 70.

The plurality of guide arms preferably consists of four spaced apart arms 58*a*, 58*b*, 58*c* and 58*d* which together span a total of between 180 and 270 degs. of the rim circumference, with the spaces 76*a*, 76*b*, 76*c* and 76*d* between the arms together spanning a total of about 90 to 180 degs. of the circumference. Preferably each arm has substantially the same span. At least two of the arms can project from the top surface a greater distance than the projection of the socket. The relative length of the arms depends on the maximum piston travel. The shoes as shown on FIG. 3 allow for larger eccentricity and by that for higher pump output, without the danger of ever leaving the bore. For smaller eccentricity the arms can be made shorter.

In the embodiment illustrated in FIGS. 5–8, the castellated arms 58 define U-shaped spaces 76*a*, 76*b*, 76*c* and 76*d* between adjacent arms, where the horizontal portion 78 of the U is defined by the top surface 70 of a step that projects a relatively shorter distance from the top surface of the base, and two facing side walls 82 and 84 of adjacent arms 58*a*, 58*b* that project a relatively longer distance from the base.

Figure 7:
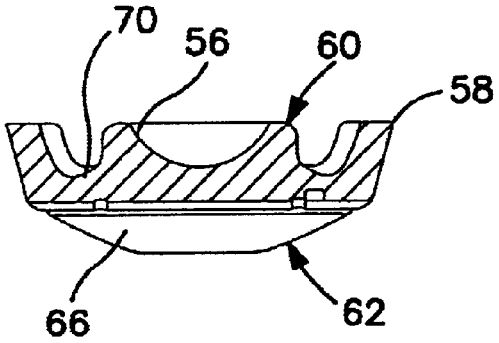
FIG. 7 is a section view along line 7—7 of FIG. 6.
Figure 6:
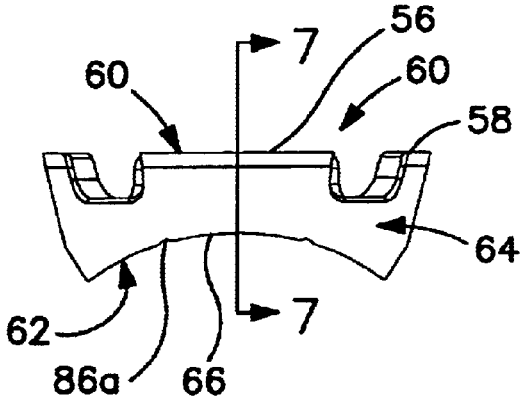
FIG. 6 is an elevation view of the sliding shoe of FIG. 5 as seen along line V6.
Figure 8:
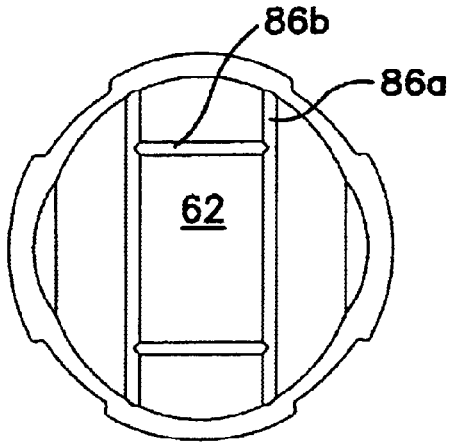
FIG. 8 is a bottom view of the shoe of FIG. 5.

In order to reduce the shoe mass and flow restriction of the shoe while it moves up and down through the surrounding fuel, two of the four castellated guide arms could be of lesser height, or could be eliminated. Preferably, the bottom surface 66 of the shoe has plural grooves 86*a,b* to facilitate lubrication at the sliding interface, It can be appreciated that the drive member 30 may be a cylinder having a drive member axis that is offset from the drive shaft axis (not shown), such that the drive member has an outer surface that is not circular with respect to the drive axis. FIGS. 6, 7 and 8 show that the bottom surface 66 of the shoe is also not circularly symmetric. Thus, neither the drive member surface nor the concave bottom surface 60 of the shoe 36 is circularly symmetric about the axis of socket 56. Moreover, it is not essential that the rim or projections of outer region 58 be circularly symmetric about the socket axis. Rather, in the broadest embodiment, the outer region 58 would have two diametrically oppose projecting arms that together could span less than 180 deg. of the circular arc around the socket axis.

Figure 2A:
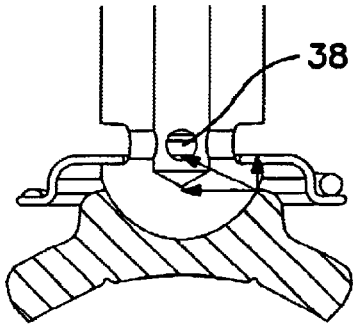
FIG. 2A PRIOR ART
FIGS. 2A and 2B show a typical prior art sliding shoe in relation to the driven end of the piston and the drive member, for illustrating the unbalanced forces that give rise to the problem solved by the present invention.
Figure 2B:
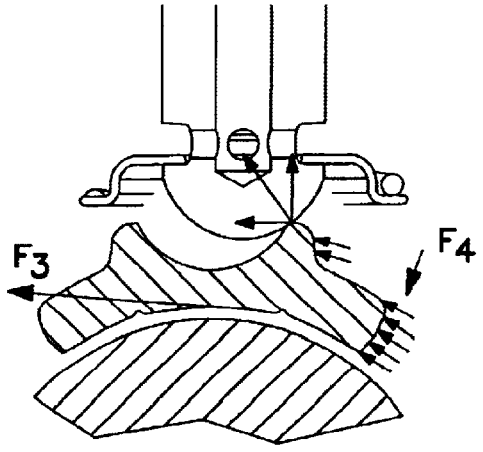
FIG. 2B PRIOR ART

FIGS. 1, 2A, 2B and 3 illustrate the problem solved by the present invention whereby in a control scheme where the inlet flow through the feed orifice 38 such as shown in FIG. 1 or in some other manner, a smaller quantity of fuel is charged into the pumping chamber 26, relative to the full available charging volume defined by the difference in the top dead center and bottom dead center positions of the piston. During the partial filling of the pumping chamber 26, there will always be a force component F1, originating from the pressure drop across the piston inlet (metering orifice plus opening pressure of the inlet check valve) acting over the effective area of the piston, trying to counter act the piston return spring force F2. Although a small separation between the sliding shoe and the surface of the actuating eccentric drive member is beneficial because it helps regenerate the layer of lubricating fuel that was "squeezed out" during the previous pumping event as a consequence of the high pumping forces. However if the separation becomes too large, the pumping reaction forces as shown in FIGS. 2A and 2B will lead very quickly to even larger separation. If the sliding shoe is not retained in some manner, the shoe socket will lose engagement and slide in the direction of rotation, driven by the fictional forces F3 as well as hydraulic forces F4 generated by the flow of fuel displaced by the eccentric rotating inside of the pump cavity into the gap between the pump housing and the shaft. The shoe will subsequently be crushed by the eccentric, resulting in a catastrophic failure of the pump.

The projecting arms of the sliding shoe according to applicant's invention, not only physically retain the shoe within the piston mounting bore in the event of such misalign mart or displacement of the shoe, but furthermore, the castillation of the arms by which spaces are present between adjacent arms, significantly reduces the hydraulic forces caused by the axial motion of the shoe through the liquid, which would otherwise further aggravate the problem described with respect to FIGS. 2A and 2B.

Figure 4:
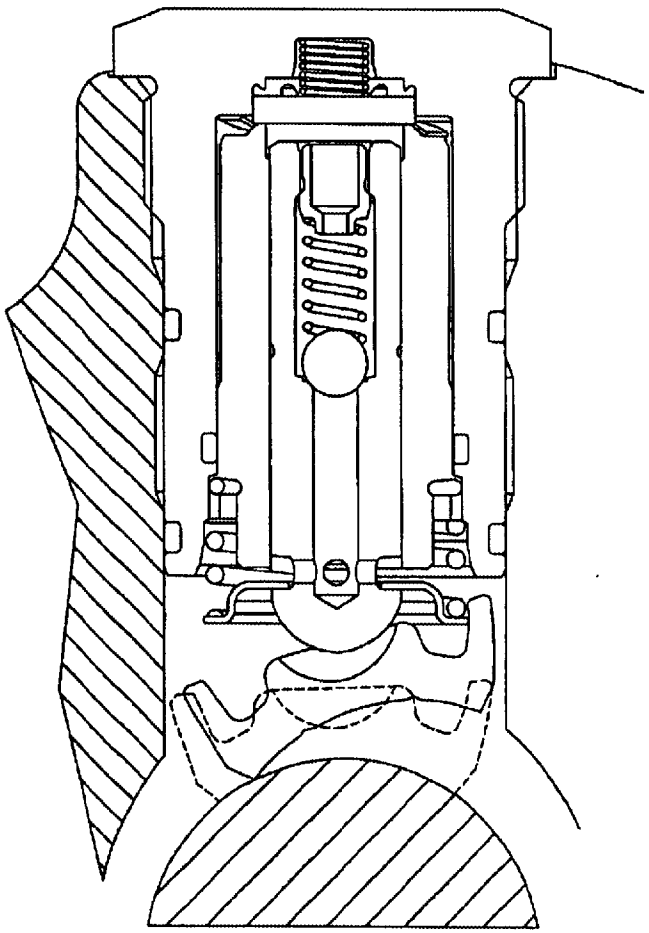
FIG. 4 is a section view similar to FIG. 3, showing the piston in the top dead center position, with the drive member in a different position resulting an even greater separation between the driven end of the piston and the socket of the sliding shoe, but with the sliding show retained within the pumping chamber mounting bore in accordance with the invention.
Figure 3:
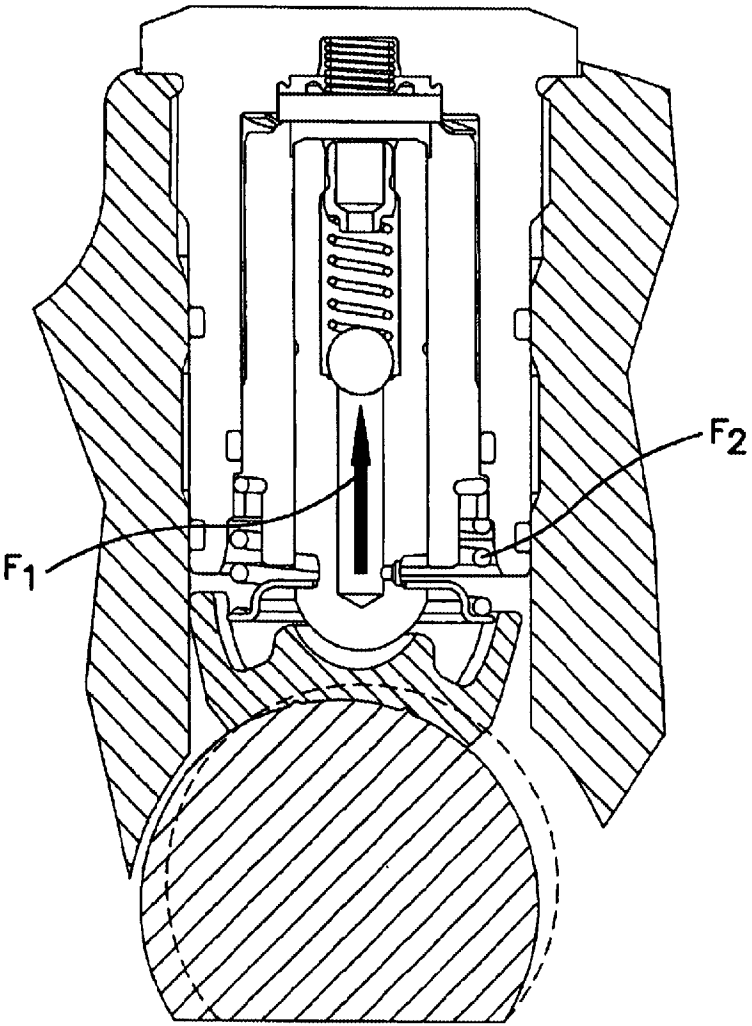
FIG. 3 is a section view similar to FIG. 1, showing the relationship of the sliding shoe, the pumping chamber mounting bore, and the drive member, during the normal top dead center position of the piston, but with momentary separation between the driven end of the piston and the sliding shoe socket.
Figure 5:
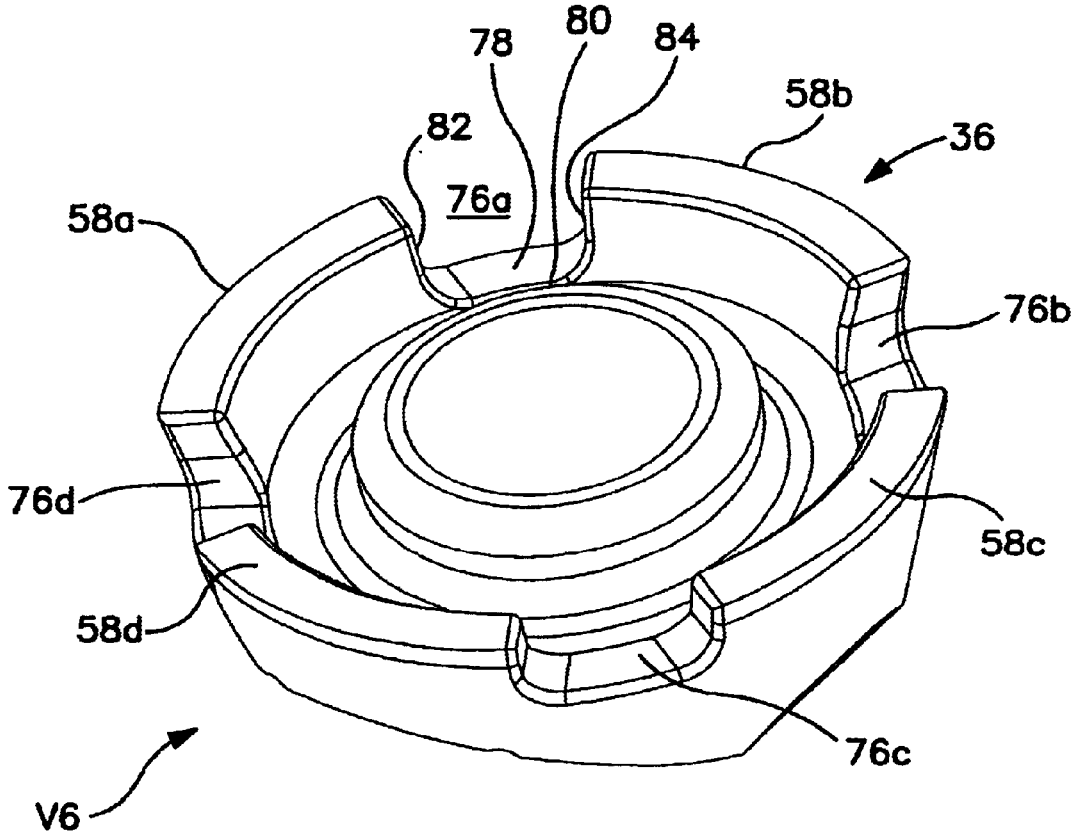
FIG. 5 is a perspective view of the preferred shape of the inventive sliding shoe.

FIGS. 3 and 4 further illustrate the effect of the operation of the invention. These figures show that even in the unlikely event of the maximum possible separation (piston in top dead center position and drive member in bottom dead center position) the outer region of the shoe not only prevents the shoe from leaving the piston mounting bore, but also ensures that the ball or similar formation at the driven end of the piston finds its socket in the shoe as the eccentric again moves into what should be the top dead center position for the piston.

As a further explanation, the phantom line for the drive member in FIG. 3 represents the maximum pumping position corresponding to top dead center of the piston, where the shoe would be engaged with the piston and the drive member would be engaged with the shoe. However, if the return spring is not fully effective as the eccentric continues rotating to the position corresponding to the solid eccentric surface in FIG. 3, the shoe may remain on the surface of the eccentric while detaching from the piston. If this continues, the worst scenario the eccentric reaches the position corresponding to the bottom dead center of the piston, but the piston is still in its top dead center position. The phantom line show the position of the shoe if it continues to be carried away from the piston by the eccentric. It is evident that the outer regions of the shoe as shoe as shown in phantom in FIG. 4, are still within the piston mounting bore and therefore cannot, even if the shoe continues to slide relative the drive member, before hydraulic or other forces out of the piston mounting bore. The solid line rendition of the mounting shoe in FIG. 4, illustrates the worst case misorientation when the drive member is returning again toward approaching the position corresponding to top dead center of the piston (i.e., approaching the phantom line shown in FIG. 3 for the drive member). The direction of this rotation would tilt the shoe but, in accordance with the present invention, the at least one arm of the shoe is restrained from moving excessively out of alignment, by contact with the spring seat for the return spring. Thus, as the eccentric continues rotation the driven end of the piston has an opportunity to reengage the socket and continue normal operation.

Although the invention has been described with respect to a radial piston pump in which the charging is controlled or restricted, it is also very beneficial for all other radial piston pumps actuated radially outwardly, particular by an eccentric drive member, inasmuch as even a miniscule amount of debris slowing down the motion of the piston, could also result in excessive separation resulting in catastrophic damage.

What is claimed is:

1. In a radial piston pump having a housing defining a central cavity; a drive member mounted for rotation in the cavity about a drive axis; at least one pumping chamber mounting bore extending radially relative to said axis, through the housing to said cavity; a piston oriented radially within the pumping chamber mounting bore and having a radially outer pumping end and a radially inner driven end cooperating with the drive member for reciprocal movement in said pumping chamber mounting bore between top dead center and bottom dead center travel limits; a sliding shoe engaging the driven end of the piston and bearing on the drive member, for providing said cooperation whereby the rotary movement of the drive member is converted to the reciprocal movement of the piston; and a return spring for urging the driven end of the piston toward the shoe and the drive member, wherein the improvement comprises:

that the sliding shoe has a central region that engages the driven end of the piston and an outer region surrounding the driven end of the piston and projecting into the pumping chamber mounting bore a distance such that for all positions of the piston relative to the drive member, at least a portion of said outer region remains within the pumping chamber mounting bore, said outer region being radially inwardly spaced from an inside surface of said pumping chamber mounting bore so long as said sliding shoe is engaged with the driven end of said piston.

2. The pump of claim 1, wherein the drive member has an outer circular surface that is offset with respect to said axis;

the driven end of the piston bears pivotally against without being rigidly attached to the central region of the shoe;

the return spring extends longitudinally along a portion of the pumping chamber mounting bore externally of the piston and acts on the driven end of the piston; and said outer region projects into said pumping chamber mounting bore in overlapped relation to the return spring when the piston bears against the central region of the shoe.

3. The pump of claim 2, wherein said outer region overlaps the return spring when the piston is at bottom dead center.

4. The pump of claim 3, wherein said outer region projection overlaps the return spring when the piston is at top dead center.

5. The pump of claim 2, wherein the piston has a substantially spherical formation at the driven end for seating with a complementary formation in the shoe, a charging orifice adjacent the spherical formation for fluid communication with the cavity, and a charging passage within the piston from the orifice to a pumping chamber at the pumping end of the piston; and when said formations are engaged, the formations are in the pumping chamber mounting bore and the outer region on the shoe extends into the pumping chamber mounting bore a greater distance than said complementary formation.

6. The pump of claim 5, wherein the piston includes a neck portion from which the spherical formation extends as a convex head portion;

a spring seat is supported in said neck portion;

said return spring is seated on said spring seat; and said outer region overlaps said spring seat.

7. The pump of claim 6, wherein the spring seat has an annular rim portion for engaging the return spring; and the rim portion of the spring seat is situated in said annular space.

8. The pump of claim 1, wherein the drive member has an outer circular surface that is offset with respect to said axis;

the driven end of the piston includes a neck portion from which a convex head portion extends into pivotal engagement against without being rigidly attached to the central region of the shoe;

a spring seat is supported in said neck portion;

said return spring is seated on said spring seat; and said outer region surrounds said spring seat when the head is seated in the central region of the shoe.

9. The pump of claim 1, wherein the outer region is an annular array of at least two spaced-apart arms forming a castellated rim around the socket.

10. The pump of claim 9, wherein the castellated rim consists of four spaced apart arms which together span a total of between about 180 and 270 degrees of said annulus, with the spaces between the arms together spanning a total of about 90 to 180 degrees of said annulus.

11. The pump of claim 1, wherein if said sliding shoe becomes disengaged from the driven end of said piston, said outer region contacts the inside surface of said pumping chamber to maintain said sliding shoe substantially in axial alignment with said pumping chamber and the central portion of said sliding shoe substantially in axial alignment with the driven end of said piston.

12. A sliding shoe for a radial piston pump, said shoe having top and bottom sides for cooperatively connecting a reciprocating piston at said top with a rotating drive member at said bottom, comprising:

a base having a concave bottom surface;

a socket portion projecting centrally on said top side; and a plurality of guide arms projecting upwardly on said top side and spaced laterally from said socket portion.

13. The sliding shoe of claim 12, wherein the plurality of guide arms form a castellated, substantially annular rim around the socket portion.

14. The sliding shoe of claim 13, wherein the base has a convex upper surface and the arms project obliquely away from each other from said upper surface.

15. The sliding shoe of claim 13, wherein the plurality of guide arms includes four spaced apart arms which together span a total of between about 180 and 270 degrees of said annulus, with the spaces between the arms together spanning a total of about 90 to 180 degrees of said annulus.

16. The sliding shoe of claim 15, wherein each arm has substantially the same span.

17. The sliding shoe of claim 12, wherein the base has a top surface from which the socket projects, and the arms project from the top surface a greater distance than the socket.

18. The sliding shoe of claim 17, wherein a "U" shaped space between adjacent arms is defined by a step that projects a relatively shorter distance from the top surface of the base and two facing side walls of adjacent arms that project a relatively longer distance from the top surface of the base.

19. The sliding shoe of claim 12, wherein the bottom surface includes at least one groove.

20. The sliding shoe of claim 12, wherein said plurality of guide arms comprises two diametrically opposed arms.

* * * * *